US008231771B2

(12) United States Patent
Crowley et al.

(10) Patent No.: US 8,231,771 B2
(45) Date of Patent: Jul. 31, 2012

(54) COATING SYSTEM AND METHOD

(75) Inventors: Carmen Crowley, Powell, OH (US); Thomas H. Croyle, Milford Center, OH (US); Todd Fitz, Dublin, OH (US); James Paul Ryan, Powell, OH (US); Masahiro Ishikawa, Dublin, OH (US)

(73) Assignee: Honda Motor Co., Ltd., Tokyo (JP)

( * ) Notice: Subject to any disclaimer, the term of this patent is extended or adjusted under 35 U.S.C. 154(b) by 1369 days.

(21) Appl. No.: 11/849,169

(22) Filed: Aug. 31, 2007

(65) Prior Publication Data

US 2009/0056623 A1 Mar. 5, 2009

(51) Int. Cl.

| | |
|---|---|
| ***C25D 13/12*** | (2006.01) |
| ***C25D 17/28*** | (2006.01) |
| ***B05B 5/025*** | (2006.01) |

(52) U.S. Cl. ..... 204/512; 204/623; 204/202; 205/137; 427/483; 118/621

(58) Field of Classification Search ..... 204/623, 204/512, 202; 118/620–640; 205/137; 427/483
See application file for complete search history.

(56) References Cited

U.S. PATENT DOCUMENTS

| | | | | | |
|---|---|---|---|---|---|
| 1,608,293 | A | | 11/1926 | Beebe | |
| 2,553,724 | A | * | 5/1951 | Ransburg | 118/635 |
| 2,808,343 | A | | 10/1957 | Simmons | |
| 2,911,323 | A | * | 11/1959 | Prance | 427/483 |
| 4,450,954 | A | | 5/1984 | O'Connell | |
| 4,573,429 | A | * | 3/1986 | Cobbs et al. | 118/322 |
| 5,055,530 | A | * | 10/1991 | Inoue | 525/423 |
| 5,099,787 | A | | 3/1992 | Powers | |
| 5,149,563 | A | | 9/1992 | Collier | |
| 5,753,042 | A | * | 5/1998 | Bauer | 118/504 |
| 5,908,120 | A | | 6/1999 | Yates et al. | |
| 6,325,899 | B1 | | 12/2001 | DeWent | |
| 2002/0160123 | A1 | | 10/2002 | Fortuyn et al. | |
| 2004/0154536 | A1 | | 8/2004 | Owed, Jr. | |

FOREIGN PATENT DOCUMENTS

| | | |
|---|---|---|
| JP | 58146466 | 9/1983 |

* cited by examiner

*Primary Examiner* — Kishor Mayekar
(74) *Attorney, Agent, or Firm* — Kenealy Vaidya LLP; Mark E. Duell

(57) ABSTRACT

An apparatus and system for electromotively coating a part can include a conveyor that has a plurality of hangars that are configured to be positively connected to respective parts that are to be coated. An attachment mechanism can be provided on the hangar and the part, the attachment mechanism being configured to exert force in more than a single direction. The part can be a conductive plastic part and can include an attachment structure that is formed thereon, for example, screw threads integrally formed in the part. The hangar can include a similar fastener that is configured to connect to the attachment structure of the part. For example, the fastener of the hangar can be a screw thread that mates with threads integrally or otherwise formed on the part. Other combinations of attachment structures and fasteners can be used to provide the mechanical and electrical coupling between the hangar and the part such that a robust electrical and mechanical connection can be achieved between the conveyor and the part to be coated.

25 Claims, 3 Drawing Sheets

COATING SYSTEM AND METHOD

BACKGROUND

1. Field

The disclosed subject matter relates to devices and methods for coating of conductive plastic and other types of parts. More particularly, the disclosed subject matter relates to connecting and grounding mechanisms and associated methods for use with conductive plastic parts that are to be electromotively coated.

2. Brief Description of the Related Art

The term "electromotive" coating process as used herein refers to any coating process in which an electrical potential exists between the part being coated and the coating material. Examples of electromotive coating processes include electrostatic coating, electrodeposition ("e-coat") processes, electromotive vapor deposition, and electroplating processes. The part may be painted or coated with any suitable water-based or organic-based composition (or water/organic mixture) including conductive primer compositions which further enhance the electronic conductivity of the article, or with a solventless organic composition by a powder coating or vapor deposition method.

In electrostatic coating, the coating or fluid (e.g., paint) is typically atomized, then negatively charged. The part to be coated is electrically neutral, making the part positive with respect to the negative coating droplets. Thus, the coating particles are attracted to the surface of the part and held there by the charge differential until cured.

When an electrostatic spray gun is used, droplets of fluid/paint pick up a charge from an electrically charged electrode located on the gun (usually at the tip of the spray nozzle of the gun). The charged droplets are discharged from the gun by a combination of fluid pressure and air pressure.

Electrostatic spraying offers high transfer efficiency and excellent edge coverage. The attraction between charged paint or fluid droplets and the part can be strong enough to cause paint overspray to curve back and adhere to the part, which results in more efficient and consistent coating.

Electrodeposition (e-coat) techniques are also known in the art. In general, organic coatings can be applied to conductive substrates such as metals or conductive plastics by electrodeposition. An aqueous media containing the organic coating to be applied is formed and is commonly referred to as an e-coat bath. The aqueous media typically contains from about 5% to about 30% solids.

An organic polymer is dispersed throughout the e-coat bath and may be positively or negatively charged. Coating of the part is accomplished by immersing the part in the aqueous media and applying a current to the part. The charged polymers are attracted to the material (part) to be coated, which has the opposite charge. The organic particles are then deposited onto the part where they coalesce forming a coating. The part is removed from the e-coat bath rinsed, and the coating is cured. Curing the organic coating to form a final film aids in making the coating tough, resistant to water and organic solvents, etc.

Electrophoretic deposition systems are characterized as either anodic or cathodic thereby indicating the function of the part to be coated. Where the part to be coated is the cathode, the system is referred to as a cathodic system. Similarly, where the part to be coated is the anode, the system is referred to as an anodic system.

Drawbacks with electromotive systems relate to the ability to maintain the part, and especially conductive plastic parts, at a particular electrical potential. In addition, certain problems can arise when intermittent or unwanted electrical or mechanical connections between any of the components of the coating system occur. For example, unwanted discharge of electrical potential can occur and variations in the electrical field during the coating process can occur due to the unwanted contact, or inadequate connection, which can lead to both quality and safety problems.

A drawback unique to electrostatic applications is that the process may not efficiently coat recessed areas due to what is known as Faraday cages (the charged droplets tend to be attracted to the sides of the recess and sharp edges instead of penetrating to the bottom). In addition, electrically conductive materials that are located near the spray area, such as the supply mechanisms, containers, and spray equipment should be grounded to prevent static buildup, to prevent unwanted electrical discharge, and to provide a quality coating. All mechanisms that carry or hold the parts should be kept clean to ensure conductivity to ground. Charges that build up on ungrounded surfaces may discharge or cause inefficient or deficient coating results. Thus there has been a long felt need in the art to provide consistent and positive connection between the part that is being coated and the carrying or holding mechanisms.

In some typical coating systems, parts to be coated are transported through a coating zone or bath by a mechanical conveyor. The parts can be constructed of a conductive material such as metal or conductive plastics. The conveyor can be made from similar materials and should be maintained at or near the potential of the part to be coated which, at least for some electrostatic processes, can be at the electrical ground potential. The parts to be coated are supported on the conveyor by hangars which maintain the parts close together and at the potential of the conveyor. The coating dispensing device can be a gun, as described above for electrostatic processes, or can be another type of spray nozzle, and includes a mechanism for electrically charging the dispensed particles of coating material to a relatively high potential, typically a high negative potential, with respect to the potential of the conveyor and hangars. Alternatively, the coating dispensing device can be a bath into which the hangars direct the part to be coated.

Intermittent contact or high-impedance contact between the parts to be coated and the conveyor can cause an electrical potential change and result in unevenly coated parts and a waste of coating material. This can occur because the charged coating material, which should migrate along electric field lines from the high potential dispensing device to the different potential maintained on the parts, instead, migrates along field lines established between the dispensing device and other articles and surfaces in the vicinity of the dispensing device which are maintained at low-magnitude potential, such as the conveyor itself. Thus, many of the benefits associated with electromotive coating are lost if the parts to be coated are not properly grounded or synchronized at a particular potential to terminate the electrostatic field.

The need for easily cleaned and operationally efficient hangars that suspend parts to be coated from conveyors that convey the parts past or through coating dispensing equipment is well established. Several types of such equipment are known, for example, the devices illustrated and described in U.S. Pat. No. 4,450,954 and U.S. Patent Publication No. 2004/0154536, the disclosures of which are hereby incorporated by reference in their entirety.

There has been a long felt need in the art to provide a ground mechanism that is sufficiently robust to efficiently maintain ground or other different potential for a part during electromotive coating. In addition, there remains a need to provide a more stable and predictable connection between a hangar or other connection device and a part to be coated. The connection should be such that relative electrical potential between all apparatus, including connecting devices, parts, paint or fluid spray, coating equipment, bath, etc., could be maintained and reproduced with ease during manufacture.

SUMMARY

According to some aspects of the disclosed subject matter, an assembly for electromotively coating a conductive plastic can include a conveyor and an electrically-conductive plastic part that is electrically and mechanically coupled with the conveyor.

According to another aspect of the disclosed subject matter, an assembly for electromotively coating a part can include a conveyor apparatus that has a track and a hangar configured to move along the track. The hangar can include a fastener, and a part that is to be coated can include an attachment structure configured to be electrically and mechanically coupled with the fastener of the hangar. At least one of the fastener and the attachment structure can be configured to impart forces against the other of the fastener and the attachment structure in at least a first direction and a second direction, wherein the first direction is different from the second direction.

According to yet another aspect of the disclosed subject matter, an electromotive coating system can include a conveyor apparatus that has a track and at least one hangar configured to move along the track, the hangar including a fastener that includes threads. At least one part to be coated can include an attachment structure configured as threads that are electrically and mechanically connected with the part (e.g., the threads can be integral with or at least adhered or attached to the part).

According to another aspect of the disclosed subject matter, a method for connecting a part to a conveyor for electromotive coating of the part can include providing a conveyor apparatus including a track and at least one hangar having a fastener and configured to move along the track. The method can also include providing at least one part to be coated, the part including an attachment structure configured to electrically and mechanically connect the part to the hangar. The method can further include connecting the part to the hangar by applying a first force between the part and the hangar that has a first directional vector, and applying a second force between the part and the hangar that has a second directional vector, wherein the first directional vector is different from the second directional vector.

In another aspect of the disclosed subject matter, an electromotive coating system can include an electromotive coating dispensing device, a substantially electrically grounded conveyor, and at least one electrically-conductive plastic part electrically and mechanically coupled with the grounded conveyor. The dispensing device can be configured to dispense coating such as a paint or other fluid.

In accordance with yet another aspect of the disclosed subject matter, a ground mechanism for coupling a conductive plastic part to a conveyor for conveyance through electromotively charged coating material is provided. The ground mechanism can include a boss extending from the part, the boss being configured to receive a fastener.

Still other features and characteristics of the disclosed subject matter will become apparent to those skilled in the art from a reading of the following detailed description of exemplary embodiments that constructed in accordance with principles of the disclosed subject matter, and taken in conjunction with the accompanying drawings.

BRIEF DESCRIPTION OF THE DRAWINGS

The disclosed subject matter of the present application will now be described in more detail with reference to exemplary embodiments of the disclosed apparatus and method, given only by way of example, and with reference to the accompanying drawings, in which.

DETAILED DESCRIPTION OF EXEMPLARY EMBODIMENTS

Figure 1:
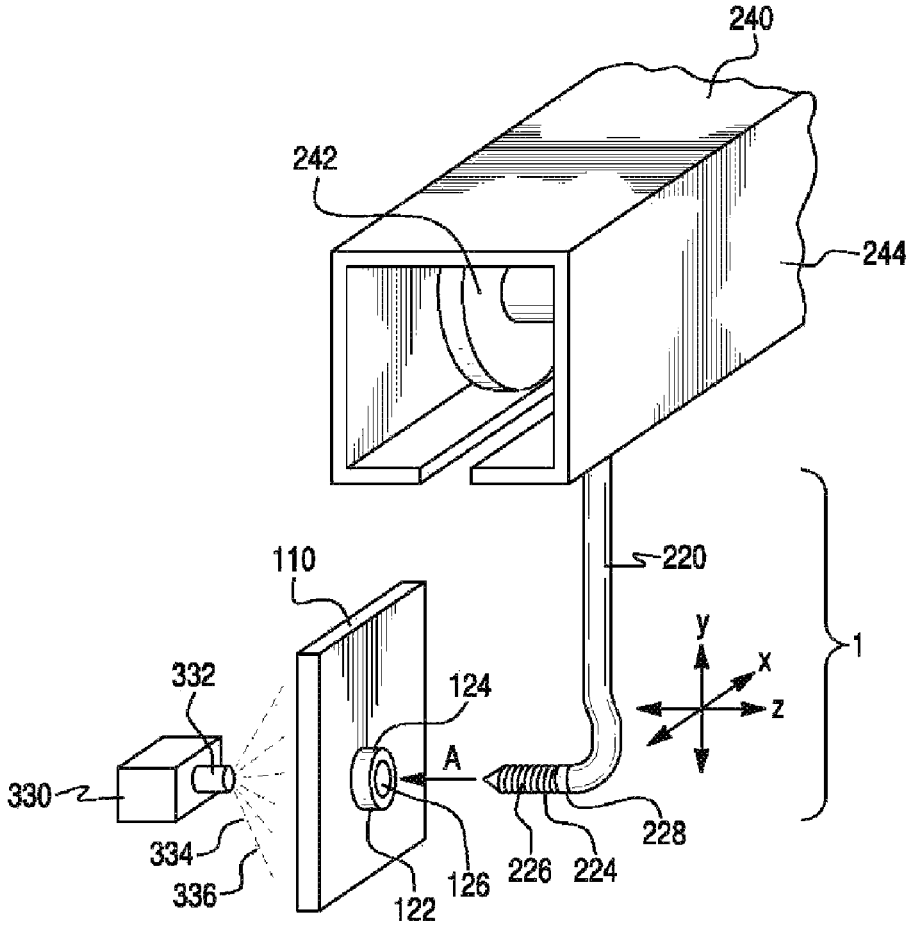
FIG. 1 is a perspective view of an exemplary embodiment of a coating system made in accordance with principles of the disclosed subject matter.

Referring to the drawing figures, like reference numerals designate identical or corresponding elements throughout the several figures.

FIG. 1 shows a perspective view of an exemplary coating system 1 that can include a hangar 220 that is configured for connection to a part 110 that is to be coated. The part 110 can be substantially any type of intermediate or final product that requires a coating, and can include vehicle parts such as vehicle body panels, fascias, bumpers, cladding, spoilers, etc. The part 110 can be made from a metal or an electrically conductive plastic or polymer, such as, for example, a blend of crystalline and semi-crystalline polymers. The polymers can include polypropylene, polyethylene, terephthalate polybutylene, nylon, nylon/polyohenylene oxide (PA/PPO), etc. The amorphous or semi-crystalline polymers can include polycarbonate, natural and synthetic polyisoprene rubbers, ethylene-propylene copolymers (EPM), ethylene-propylene diene rubbers (EPDM), chlorinated rubbers, nitrile rubbers, polystyrene, polyphenylene oxides, methylmethacrylate styrene-butadiene block copolymers, polyether sulfones, polysulfones, polyarylates, styrene-butadiene block copolymer, and mixtures thereof, etc.

Figure 2:
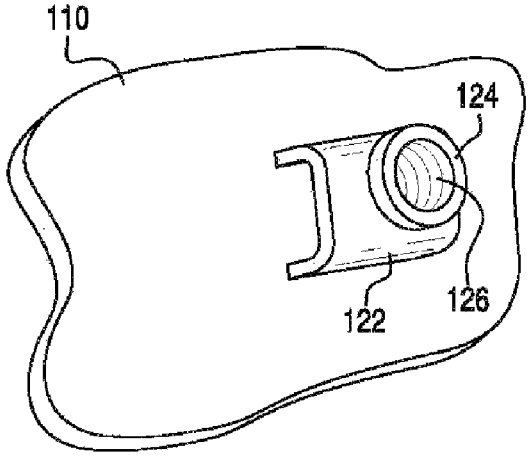
FIG. 2 is a partial perspective view of an exemplary part to be coated made in accordance with principles of the disclosed subject matter.

As shown in FIG. 2, the part 110 can include an attachment structure 124 that is shaped to receive and connect to a conveyor portion, such as the hangar 220. The attachment structure 124 can include a positive attachment structure, such as threads 126. A boss 122 can be offset from the part 110 to allow for more space for the threads 126. Other positive attachment structures can include clamps, clips, snap fits, collars, etc. The positive attachment structure can be configured to apply a force in at least two different directions with respect to the attachment structure 124 located on the part 110 such that a robust electrical and mechanical coupling are achieved and such that the part 110 is adequately grounded or electrically connected with the hangar. In addition, some attachment structures, such as threads 126 are configured to apply a force in all three x, y, z orthogonal directions to ensure positive mechanical and electrical attachment between the part 110 and the hangar 220.

The grounding mechanism or attachment structure 124 can be configured as a boss 122 extending from the part 110. The boss 122 includes threads 126 configured to connect to a fastener 224 on the hangar 220. The connection between the boss 122 and the fastener 224 can be sized and shaped such that a force is exerted by the fastener 224 onto the part 110 in at least two orthogonal directions and possibly all three orthogonal directions, such as when the threads 126 of the attachment structure 124 lock with threads 226 of the hangar 220. The boss 122 can be integrally molded with the part 110 to form a single piece of unitary construction via injection molding or other molding techniques. In the alternative, the boss 122 can be machined into the part 110 depending on the specific geometry of the part 110 and boss 122 and coating requirements.

The boss 122 can be sized and structured to allow the fastener 224, such as, for example, a screw-type metal fastener 224 with threads 226, to engage the conductive plastic boss 122 by cutting into the boss 122. The boss 122 can include threads 126 or the boss 122 can simply be an opening in the part 110 that can be tapped when the fastener 224 is threaded into boss 122 (or into the part 110 itself without boss 122). With multiple threads 226 engaging the boss 122, the part 110 can be firmly coupled with a conveyor such that the part 110 can proceed through an electromotive coating process without deformation or electrical arching. The boss 122 can be provided to ensure adequate space for the threads 126 and 226 of the part 110 and hangar 220 to interlock with each other. However, if the geometry of the part 110 permits, threads 126 can be provided directly within the part 110 (via molding, machining, etc.) and no boss 122 is required.

Referring back to FIG. 1, the electromotive coating system 1 can include a coating dispensing device 330 configured to dispense a coating to the part 110. During operation, the conveyor 240 is substantially electrically grounded and includes a plurality of hangars 220 that are suspended from a track 244. Rollers 242 provided at one end of the hangars 220 follow the track 244 and convey the hangars 220 and the part 110 attached to the hangars 220 through a coating area where the coating dispensing device 330 is located. Coating material 334 is ejected from a nozzle 332 of the coating dispensing device 330. Particles of the coating material 334 migrate along an electric field 336 established between the dispensing device 330 and the part 110 and deposit on the part 110. The particles' electrical charges are then conducted away to ground via the attachment structure 124, the hangars 220, and ultimately via grounded components of the conveyor 240 to which the part 110 is electrically coupled. Of course, a similar conveyor 240, hangar 220, and part 110 to be coated can be utilized in an e-coat bath or other type of electromotive coating system.

The connection between the attachment structure 124 of the part 110 and the fastener 224 located on the hangar 220 is sufficiently robust to maintain a ground (or to maintain a constant electrical potential) of the part 110 through all forces encountered during the coating process and through the heat encountered during transfer through curing ovens. The positive connection also allows coating material to adhere to the part 110 in a substantially even manner and prevents accidental or unwanted electrical current discharges.

Figure 3:
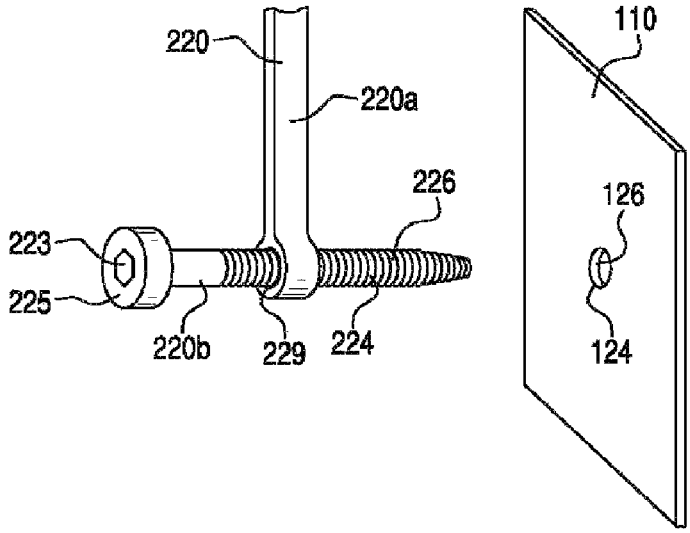
FIG. 3 is a partial perspective view of another exemplary coating system made in accordance with principles of the disclosed subject matter.

FIG. 3 shows a partial perspective view of another embodiment of a coating system 1 made in accordance with principles of the disclosed subject matter. In this embodiment, hangar 220 includes a two piece configuration, namely, an upper portion 220*a* and a lower screw portion 220*b*. The upper portion 220*a* includes a threaded though hole 229 located a lower end of the upper portion 220*a* of the hangar 220 for connection to mating threads 226 on the lower screw portion 220*b* of the hangar 220. The above described connection structure between the upper portion 220*a* and lower screw portion 220*b* of the hangar 220 allows for relative movement between portions 220*a* and 220*b* while maintaining consistent electrical and mechanical coupling between the portions. A head 225 with connection structure 223 can be located at one end of the lower screw portion 220*b*. During operation of the coating system, a rotary screw-type tool can be used to attach to the connection structure 223 of the lower screw portion 220*b* and to rotate the lower screw portion 220*b* and drive it into (or out of) a part 110 via mating threads 126 located in the attachment structure 124 of the part 110. Thus, automatic attachment and removal of parts 110 from the hangars 220 can be accomplished.

Figure 4:
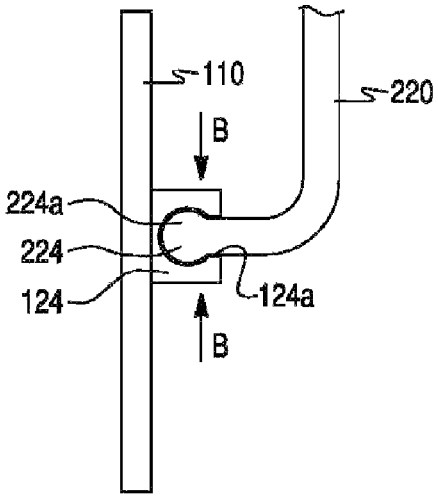
FIG. 4 is a partial side view of another embodiment of a part and hangar made in accordance with principles of the disclosed subject matter.

It should be appreciated that other types of positive connectors may be used in place of the screw-type fasteners 224/attachment structures 124 shown in FIGS. 1-3. For example, FIG. 4 shows a partial side view of another embodiment of a coating system 1 in which the hangar 220 includes a fastener 224 that is configured to include a snap fit structure 224*a*. A mating attachment structure 124 is provided on the part 110 and can include, for example, an opening 124*a* that is shaped similarly but is slightly smaller than the snap fit structure 224*a*. Thus, when the snap fit structure 224*a* is snapped into the opening 124*a*, the walls of the opening 124*a* exert forces about substantially the entire outer surface of the snap fit structure to maintain strong and consistent mechanical and electrical contact between the hangar 220 and the part 110. Of course, the attachment structure 124 can be shaped differently and can be replaced with other similar snap fit type structures, such as a tight fitting spline, keyways, hook devices, etc., as long as the connection between the conveyor and part 110 is sufficiently robust to maintain a ground during the electromotive coating process.

Figure 5:
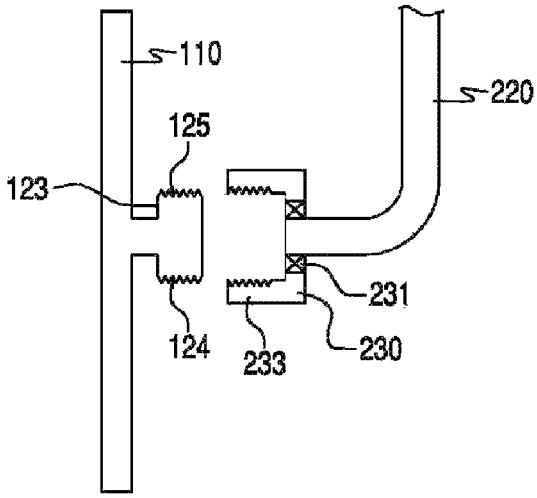
FIG. 5 is a partial side view of another embodiment of a part and hangar made in accordance with principles of the disclosed subject matter.

FIG. 5 shows a partial side view of another embodiment of a coating system 1 made in accordance with principles of the disclosed subject matter. In this embodiment, the part 110 includes an attachment structure 124 shaped as a post 123 that has threads 125 located on an exterior side surface of the post 123. The hangar 220 includes a rotatable collar 230 that has mating threads 233 for connection to the post 123. The side surface of the post 123 can be slightly tapered so that as the collar 230 is turned and the mating threads 125 and 233 engage each other, at a certain point the collar 230 and post 123 will lock with each other via tight engagement of the threads 125 and 233 with each other. A bearing 231 can be used to rotatably mount the collar 233 with a lower portion of the hangar 220.

Figure 6:
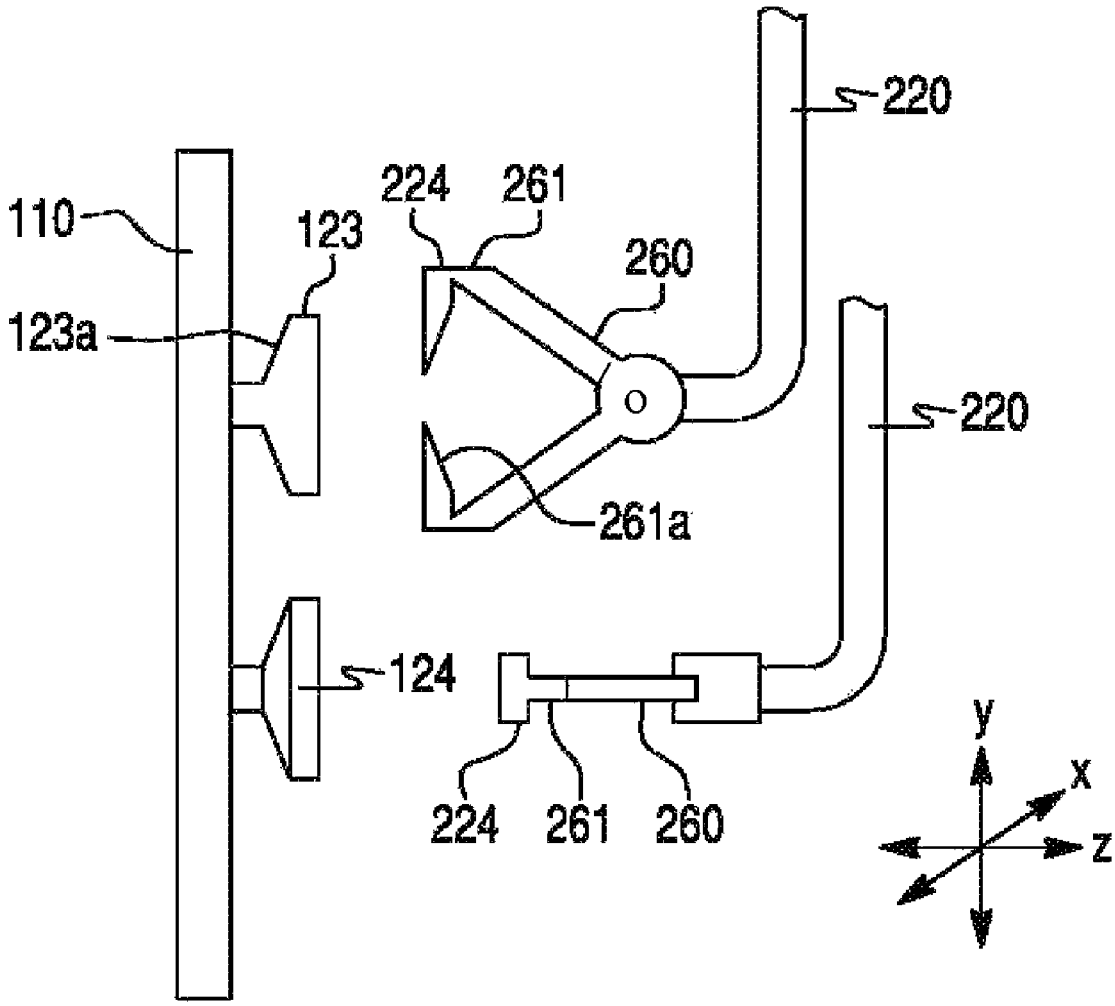
FIG. 6 is a partial side view of another embodiment of a part and hangar made in accordance with principles of the disclosed subject matter.

FIG. 6 shows a partial side view of another embodiment of a coating system 1 made in accordance with principles of the disclosed subject matter. In this embodiment, the part 110 includes an attachment structure 124 shaped as a post 123 that can be block shaped and include flat sides located at four exterior surfaces around the periphery of the post 123. In this case, a plurality of hangars 220 can be provided that include a spring clip 260 at the lower end thereof. Each spring clip 260 includes two spring clip arms 261 that are biased towards each other by a spring. Each of the spring loaded arms 261 engages a respective one of the posts 123 so that a positive connection between the hangars 220 and the part 110 can be provided. For example, the spring loaded arms 261 and/or the posts 123 can be arranged such that the spring loaded arms 261 of a first hangar 220 impart a force in a first "x" direction against a respective post 123 of the part 110. A second spring clip 260 and/or post 123 can be configured such that the second spring loaded arms 261 imparts a force in a second "y" direction (possibly orthogonal to the first direction) against the respective post 123 of the part 110. The posts 123 and/or the spring loaded arms 261 can be configured to also require that the spring loaded arms 261 impart a force in the "z" direction. For example, the posts 123 and/or the spring loaded arms 261 can include an inclined surface 123*a* and/or 261*a* that mate with each other and result in the above-described holding force applied in the "z" direction.

The above specific and exemplary embodiments can be modified and changed without departing from the spirit and scope of the invention. For example, the spring arms 261 can be shaped in a semicircle or in a non-symmetrical manner to provide additional and/or differently directed force vectors when the spring arms 261 connect to the posts 123. In addition, any of the above-described embodiments can utilize a single or a plurality of hangars 220 corresponding to each part 110 that is to be moved through the conveyor system. The fasteners 124 and attachment structures 224, such as threads 126, 226, can be integrally formed on the part 110 and the hangar 220, or separate structures that include threads can be attached, mounted on, or otherwise adhered to the hangar 220 or part 110. In addition, while the conveyor system is shown as having a hangar 220 that has wheels 242 that follow track 244, other structures can be used without departing from the spirit and scope of the disclosed subject matter. For example, a continuous belt track can be used with hangars 220 that are permanently connected to the belt or detachable from the belt. Alternatively, magnets can be used to attach the hangars 220 to the belt, ball bearings, or other track structures.

While the disclosed subject matter has been described in detail with reference to exemplary embodiments thereof, it will be apparent to one skilled in the art that various changes can be made, and equivalents employed, without departing from the scope of the disclosed subject matter. Other embodiments of the invention will be apparent to those skilled in the art from consideration of the specification and practice of the disclosed subject matter. It is intended that the specification and examples be considered as exemplary only.

What is claimed is:

1. An electromotive coating assembly comprising:
a conveyor apparatus and a vehicle part, wherein
the conveyor apparatus includes,
a track, and
a hangar configured to move along the track, the hangar including a fastener,
the vehicle part including an attachment structure configured to be electrically and mechanically coupled with the fastener of the hangar and the vehicle part is one of a vehicle body panel, a vehicle fascia, a vehicle bumper, a vehicle cladding, and a vehicle spoiler, and
at least one of the fastener and the attachment structure is configured to impart force against the other of the fastener and the attachment structure in at least a first direction and a second direction, and the first direction is different from the second direction.

2. The assembly of claim 1, wherein the attachment structure of the part includes a boss configured to receive the fastener of the hangar.

3. The assembly of claim 1, wherein the part is a conductive plastic part.

4. The assembly of claim 1, wherein the fastener includes a metal threaded fastener.

5. The assembly of claim 1, wherein the attachment structure includes threads integrally formed in the part.

6. The assembly of claim 1, wherein the fastener includes a snap-fit connector.

7. The assembly of claim 1, wherein the fastener includes a spring biased clip.

8. The assembly of claim 1, further comprising:
an electromotive coating dispensing device configured to dispense coating, wherein
the conveyor is configured to move the part into proximity of the dispensing device.

9. The assembly of claim 8, wherein the electromotive coating dispensing device includes an e-coat bath.

10. The assembly of claim 1, wherein the conveyor apparatus is substantially electrically grounded.

11. The assembly of claim 1, wherein the attachment structure is configured to connect exclusively to the fastener.

12. An electromotive coating system, comprising:
a conveyor apparatus and at least one part,
the conveyor apparatus including,
a track, and
at least one hangar configured to move along the track, the hangar including a fastener that includes threads; and
the part including an attachment structure configured as threads that are electrically and mechanically connected with the part, wherein
the attachment structure includes a boss having a support integral with and extending away from a surface of the part and a threaded portion connected to the support and spaced away from the surface of the part.

13. The system of claim 12, wherein the threads of the part are integrally formed in the part.

14. The system of claim 12, further comprising:
a coating dispensing device, wherein the conveyor is configured to move the at least one part into proximity of the dispensing device.

15. The system of claim 12, wherein the part includes a boss, and the threads of the part are located in the boss.

16. The system of claim 12, wherein the part is a conductive plastic part.

17. The assembly of claim 12, wherein the fastener includes a metal threaded fastener and also includes a bearing that is configured to permit the fastener to rotate with respect to the hangar.

18. The assembly of claim 12, wherein the attachment structure includes threads integrally formed in the part.

19. The assembly of claim 12, wherein the hangar includes means for connecting to a tool for automatically connecting the hangar and the part.

20. The assembly of claim 12, wherein the boss includes:
a base; and
a pair of walls connected to and extending from the base and integrally connected to the surface of the part, wherein
the threaded portion is located on the base, and
the pair of walls space the base and the threaded portion away from the surface.

21. A method for connecting a vehicle part to a conveyor apparatus for electromotive coating of the part using the electromotive coating assembly as recited in claim 1, comprising:
connecting the part to the hangar by applying a first force between the part and the hangar that has a first directional vector, and applying a second force between the part and the hangar that has a second directional vector, wherein the first directional vector is different from the second directional vector.

22. The method of claim 21, wherein the first directional vector is orthogonal to the second directional vector.

23. The method of claim 21, further comprising:

applying a third force between the part and the hangar that has a third directional vector, and wherein the third directional vector is orthogonal to at least one of the first directional vector and the second directional vector.

24. The method of claim 21, wherein connecting the part to the hangar includes screwing a portion of the hangar into the part.

25. The method of claim 24, wherein providing at least one part includes providing a conductive plastic part and providing an integral screw thread on the part.

* * * * *